US006404316B1

(12) United States Patent
Busletta et al.

(10) Patent No.: US 6,404,316 B1
(45) Date of Patent: Jun. 11, 2002

(54) MAGNETIC DEVICE AND METHOD OF MANUFACTURE THEREFOR

(75) Inventors: Galliano R. Busletta; Robert J. Catalano, both of Mesquite; Paul J. Offer, Jr., Dallas; Matthew A. Wilkowski, Mesquite, all of TX (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/568,169

(22) Filed: May 9, 2000

(51) Int. Cl.[7] ..... H01F 27/30

(52) U.S. Cl. ..... 336/198; 336/205; 336/206; 336/208

(58) Field of Search ..... 336/198, 192, 336/96, 205–208

(56) References Cited

U.S. PATENT DOCUMENTS 5,264,815 A * 11/1993 Umeya et al. ..... 336/96
5,369,389 A * 11/1994 Schrammek et al. ..... 336/206
5,696,477 A * 12/1997 Yamamori ..... 336/192
5,815,061 A * 9/1998 Ho ..... 336/192
5,917,397 A * 6/1999 Sasahara ..... 336/206

FOREIGN PATENT DOCUMENTS

JP 60-76113 * 4/1985
JP 6-13246 * 6/1994
JP 10-144537 * 5/1998

* cited by examiner

*Primary Examiner*—Lincoln Donovan
*Assistant Examiner*—Tuyen T. Nguyen
(74) *Attorney, Agent, or Firm*—Hitt Chwang & Gaines PC

(57) ABSTRACT

A magnetic device and a method of manufacture therefor. In one embodiment, the magnetic device includes: (1) a bobbin having a winding guide and molded-in margins proximate opposing inside flanges of the bobbin, each of the opposing inside flanges having at least one notch formed in an inside face of each of said opposing inside flanges; (2) an inner winding wound about the winding guide and between the molded-in margins; (3) an outer winding wound about the inner winding and the winding guide and between the flanges; and (4) an insulating plate, provided in the at least one notch and interposed between the inner and outer windings, a thickness of the insulating plate providing a predetermined creepage distance between at least one lead of the inner winding and the outer winding.

8 Claims, 3 Drawing Sheets

MAGNETIC DEVICE AND METHOD OF MANUFACTURE THEREFOR

TECHNICAL FIELD OF THE INVENTION

The present invention is directed, in general, to magnetic devices, and, more specifically, to a magnetic device employing an isolation barrier and a method of manufacture therefor.

BACKGROUND OF THE INVENTION

Electronic manufacturers are constantly striving to make electronic components even smaller, especially in the field of magnetic devices. Miniature magnetic devices are used in a wide variety of electronic equipment such as telephones, televisions, computers, etc. With overall dimensions of the devices becoming smaller, the design of the magnetic devices presents unique challenges. The structure of the miniature devices must accommodate special features that are necessary to the manufacturability and electrical performance thereof.

A magnetic device is a device that uses magnetic material arranged in a defined structure for shaping and directing magnetic fields in a predetermined manner to achieve a desired electrical performance. The magnetic fields in turn act as the medium for storing, transferring and releasing electromagnetic energy. As a specific example of magnetic devices, transformers are composed of two or more windings wound about a bobbin with a magnetic core inserted through the bobbin. The bobbin may be made of virtually any suitable dielectric material. The insulated windings are wound about the bobbin in patterns to achieve specific electrical characteristics. The number of windings and the number of turns per winding is dictated by the function of the transformer in the intended circuit.

The bobbin may be manufactured separate from or integral with a base that provides the physical support for the bobbin. The transformer is electrically connected to the circuit by contacts extending from the base. A core of magnetic permeability, often ferrite, is inserted into the bobbin to shape the magnetic field. The core is often made in two pieces with an "E" shaped cross section. The central poles of the E-shaped core halves are inserted into opposite ends of the bobbin and the poles at the center of the bobbin. The complete transformer assembly is held together by various physical means such as an adhesive or spring clip.

Transformers work on the general principle that a change in current flowing through the primary winding, which is isolated from the secondary winding, creates a magnetic flux which causes a change in the current to flow in the secondary winding. The ratio of primary-to-secondary current is established by the number of windings in the secondary coil related to the number of windings in the primary coil. This, in turn, creates a voltage which is the product of the number of turns multiplied by the change in flux. This product is also proportional to a change in current multiplied by the inductance.

As the electronic devices employing magnetic devices continue to be made smaller, it is necessary to design a more compact and lower profile magnetic device (e.g., transformer). The limitation of "creepage," however, can adversely affect the design and operation of the magnetic device. Creepage is generally defined as the transference of electrical current from one winding in a transformer to another winding in the same transformer by way of a conductive path forming a temporary bridge along a surface of a dielectric material separating the windings. The leakage current generally occurs as a result of ionization of air and insufficient creepage distance. Additionally, a minimum creepage distance is often required to comply with safety standards.

For example, a transformer may have a primary winding wound about a bobbin with a primary lead extending therefrom coupled to an input terminal of the transformer. In addition, the transformer may have a secondary winding wound concentrically about the same bobbin and around the primary winding. Although the primary winding and the secondary winding are separated by an insulator, the lead coming from the primary winding and terminating at the input terminal passes very close to the secondary winding. Because the primary lead passes very close to the secondary winding, there is the likelihood of creepage between the primary and secondary windings (e.g., at the point where the lead of the primary winding and the secondary winding are in the closest proximity to each other) thereby resulting in a potential short-circuit in the transformer. The distance between the point on the primary lead and the point on the secondary winding along the surface of which the creepage occurs is commonly known to those skilled in the art as the creepage distance.

As alluded to above, to help prevent creepage in magnetic devices, standards have been instituted defining minimum insulation permitted in a transformer. The standards are promulgated by administrative bodies such as the International Electrotechnical Commission (IEC) to, among other things, increase the safety of devices employing components such as magnetic devices (see, for instance, IEC Standard 60950, third edition, 1999). Included in these standards are the minimum creepage distances depending on the specifications of the transformer and the circuit into which the transformer is to be employed. The standards are becoming more universally accepted. Therefore, minimum creepage distance in magnetic devices is becoming a more important factor in the design of such devices.

In the prior art, two commonly employed methods are employed to assure a minimum creepage distance. The first method is to manufacture two separate bobbins, each one with a winding wound thereabout and leads affixed to the respective terminals. One bobbin is then placed inside of the other so that the leads of one winding and the other winding are isolated from each other. Although effective for ensuring a minimum creepage distance, the use of two bobbins has several disadvantages. First, the two-bobbin method requires the manufacture of two bobbins rather than only one, thus resulting in increased parts and manufacturing costs. Second, the use of two bobbins is better suited for larger transformers because of the difficulty associated with manufacturing miniature bobbins that fit together, one inside the other. Third, the use of one bobbin inside of another commonly leads to a large leakage inductance as a result of the space between the windings. Thus, the two bobbin approach is not the design of choice.

The second and more commonly employed method to assure a minimum creepage distance is the use of sleeves placed on the wire leads of the inner winding. However, like the two bobbin approach discussed above, the use of wire sleeves also has major disadvantages. Although the use of wire sleeves is employable in the manufacture of small transformers, placing the wire sleeves on each of the leads of the inner winding is a labor-intensive process that must be completed by hand. As a result, the costs of manufacturing small transformers having wire sleeves on the leads of the inner windings is high. In addition, although placing sleeves on the large leads of large transformers may appear at first glance to be a trivial task, placing sleeves on extremely small leads of miniature transformers becomes a tedious and time-consuming chore. As a result, labor costs, and thus the overall costs of manufacturing, are again elevated.

Accordingly, what is needed in the art is a magnetic device, and related method, that maintains a predetermined creepage distance therein, but overcomes the deficiencies of the prior art.

SUMMARY OF THE INVENTION

To address the above-discussed deficiencies of the prior art, the present invention provides a magnetic device and a method of manufacture therefor. In one embodiment, the magnetic device includes: (1) a bobbin having a winding guide (or core tube) and molded-in margins proximate opposing inside flanges of the bobbin, each of the opposing inside flanges having at least one notch formed in an inside face of each of said opposing inside flanges; (2) an inner winding wound about the winding guide and between the molded-in margins; (3) an outer winding wound about the inner winding and the winding guide and between the flanges; and (4) an insulating plate, provided in the at least one notch and interposed between the inner and outer windings, a thickness of the insulating plate providing a predetermined creepage distance between at least one lead of the inner winding and the outer winding.

The present invention, in one aspect, introduces the broad concept of a magnetic device employing a bobbin having flanges adapted to receive an isolation barrier. The isolation barrier is interposed between inner and outer windings of the magnetic device to allow a creepage distance between the inner and outer windings to be above a predetermined amount. The magnetic device may thus meet insulation requirements promulgated by various standards bodies, such as the International Electrotechnical Commission (IEC).

In one embodiment of the present invention, the magnetic device further includes a magnetic core proximate the inner and outer windings. The magnetic core may thus impart a desired magnetic property to the inner and outer windings. In a related embodiment, the magnetic device further includes a spring clip that retains the magnetic core on the bobbin. The magnetic core may, in an advantageous embodiment, include first and second magnetic core portions. The spring clip may thus secure the first and second magnetic core portions to the bobbin. Those skilled in the pertinent art realize, of course, that the spring clip is not necessary to practice the present invention.

In one embodiment of the present invention, the isolation barrier includes an insulating plate. The insulating plate may be a molded plastic plate, a polyamide plate, or a nomex plate. Of course, the use of other materials for the insulating plate is well within the broad scope of the present invention. In a related embodiment, the isolating barrier further includes a layer of insulating tape placed over the insulating plate. The insulating tape may thus secure the insulating plate in place within the magnetic device. Of course, placing the insulating tape over the insulating plate is not necessary to practice the present invention.

In one embodiment of the present invention, the isolation barrier provides the creepage distance between a lead of the inner winding and a body of the outer winding. The magnetic device may thus avoid the use of sleeving to compensate for the lack of creepage distance between the lead of the inner winding and the body of the outer winding.

In one embodiment of the present invention, the predetermined amount is determined by a safety standard. The safety standards may be promulgated by any of various standards bodies, such as Underwriters Laboratories, Inc. (UL) and the IEC. Those skilled in the pertinent art are familiar with these and other relevant standards bodies.

In one embodiment of the present invention, the molded-in margins are slotted to allow at least one lead of the inner winding to terminate on a winding terminal of the magnetic device. In a related embodiment, the flanges are slotted to allow at least one lead of the outer winding to terminate on a winding terminal of the magnetic device. The leads of the inner and outer windings may thus be directly connected to the respective winding terminals while maintaining the predetermined creepage distance.

The foregoing has outlined, rather broadly, preferred and alternative features of the present invention so that those skilled in the pertinent art may better understand the detailed description of the invention that follows. Additional features of the invention will be described hereinafter that form the subject of the claims of the invention. Those skilled in the pertinent art should appreciate that they can readily use the disclosed conception and specific embodiment as a basis for designing or modifying other structures for carrying out the same purposes of the present invention. Those skilled in the pertinent art should also realize that such equivalent constructions do not depart from the spirit and scope of the invention in its broadest form.

DETAILED DESCRIPTION

Figure 1:
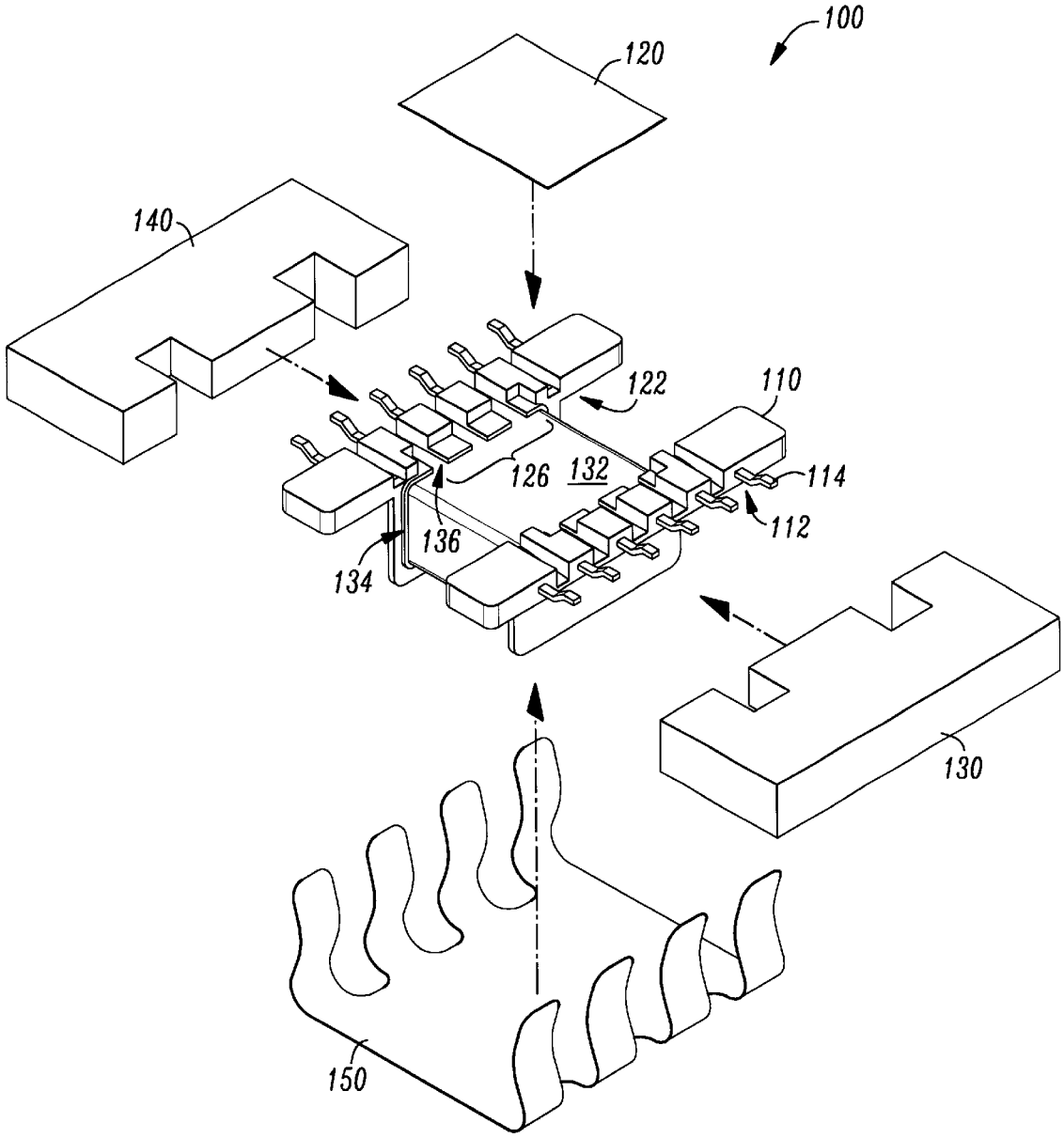
FIG. 1 illustrates an exploded isometric view of an embodiment of a magnetic device constructed according to the principles of the present invention.

Referring initially to FIG. 1, illustrated is an exploded isometric view of an embodiment of a magnetic device 100 constructed according to the principles of the present invention. The magnetic device 100 includes a terminal bobbin 110 formed about a plurality of terminals (one of which is generally designated 112) having a winding terminal 114. The magnetic device 100 further includes an isolation barrier 120. In the illustrated embodiment, the isolation barrier 120 is an insulating plate. The magnetic device 100 further includes first and second core halves 130, 140, formed as an E-shaped core. The magnetic device 100 still further includes a spring clip 150.

The terminal bobbin 110 is manufactured of dielectric material. An inner winding (not shown) is wound about a winding guide 132 of the terminal bobbin 110 between molded-in margins (one of which is generally designated 134) thereof. The isolation barrier 120 is placed atop the inner winding, in between opposing inside flanges (one of which is designated 122) of the terminal bobbin 110. In a preferred embodiment, the opposing inside flanges 122 of the terminal bobbin 110 include a notch 126 to support and align the isolation barrier 120. Also in a preferred embodiment, the isolation barrier 120 is composed of molded plastic, polymide, or nomex. Of course, the present invention is not limited to a specific dielectric material.

Additionally, an insulating material (see FIG. 2), perhaps insulating tape, is placed atop the inner winding to decrease creepage between the inner winding and an outer winding. The outer winding is then wound about the winding guide 132 and between the flanges 122. The molded-in margin 134 and flange 122 are slotted (e.g., slot 136) to allow at least one lead of the inner winding to terminate on a winding terminal (for instance, terminal 114) and at least one lead of the outer winding to terminate on a winding terminal of the magnetic device 100.

The first and second core halves 130, 140 are placed into corresponding sides of an aperture in the terminal bobbin 110. In a preferred embodiment, the first and second core halves 130, 140 are composed of a ferrite material, but any material suitable for use as a core is within the broad scope of the present invention. The spring clip 150 is placed over the first and second core halves 130, 140 to secure the core halves 130, 140 within the aperture and about the terminal bobbin 110. Although the magnetic device 100 in FIG. 1 is illustrated having a spring clip 150 to secure the placement of the first and second core halves 130, 140, any means used to hold the assembly together is within the broad scope of the present invention. The use of the spring clip 150 is preferred over adhesives or other means because of the simplicity of assembly of the magnetic device 100.

Figure 2:
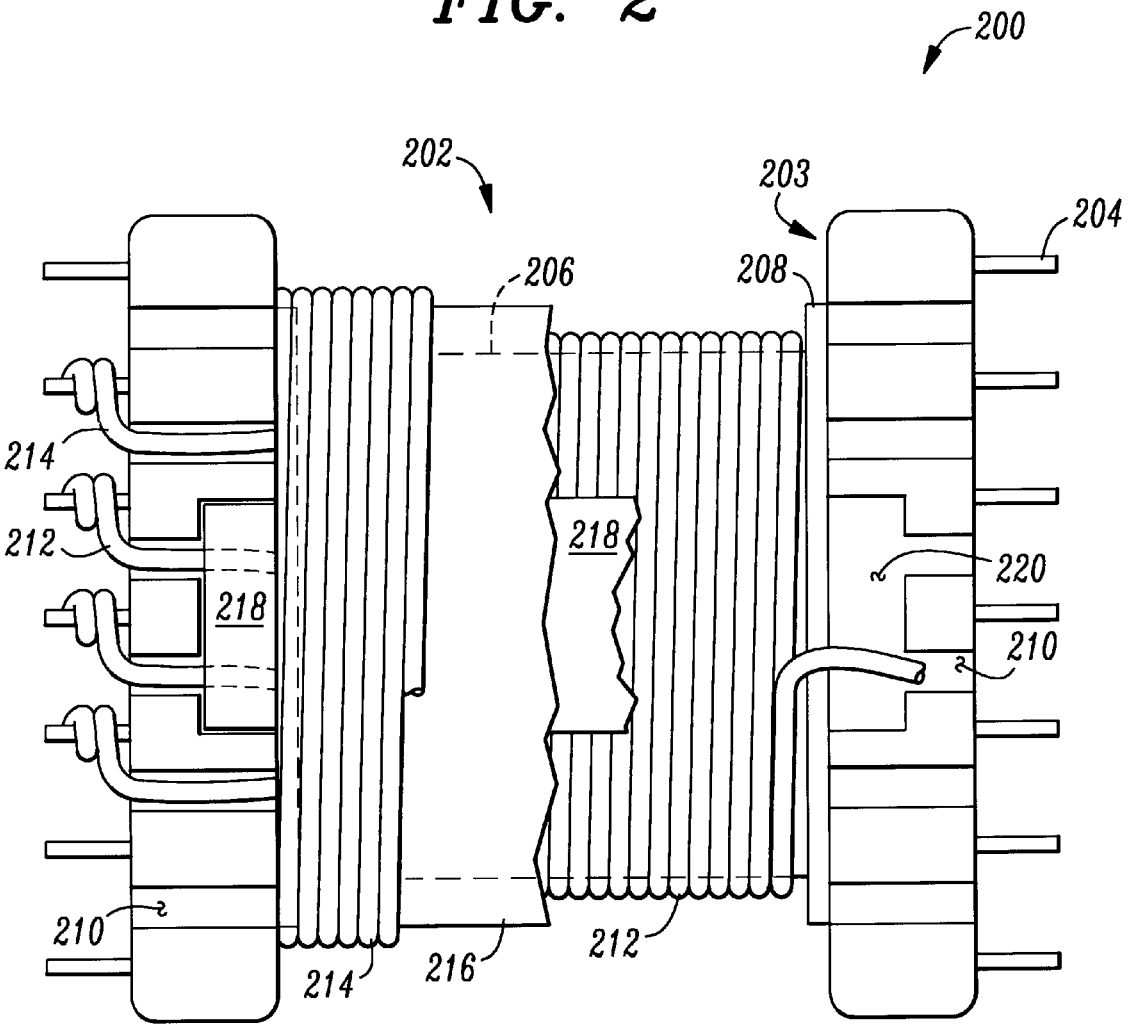
FIG. 2 illustrates a cross-sectional view of an embodiment of a magnetic device constructed according to the principles of the present invention.

Referring now to FIG. 2, illustrated is a cross-sectional view of an embodiment of a magnetic device 200 constructed according to the principles of the present invention. The magnetic device 200 includes a terminal bobbin 202 having molded-in terminals, one of which is designated 204. The terminals 204 extend from the terminal bobbin 202 and are distal from one another. The terminal bobbin 202 is constructed from a dielectric material, such as molded plastic. The terminal bobbin 202 further includes a winding guide 206 for winding inner and outer windings 212, 214 thereupon.

In addition, the winding guide 206 constrains the placement of the windings within opposing inside flanges (one of which is designated 203) proximate the winding guide 206. The terminal bobbin 202 further includes molded-in margins 208 created therein located proximate the opposing inside flanges 203. The flanges 203 of the terminal bobbin 202 include lead slots 210 for the winding leads of the inner and outer windings 212, 214 to terminate on the terminals 204. The lead slots 210 are created through both the opposing inside flanges 203 and the molded-in margins 208 of the winding guide 206. The terminal bobbin 202 still further includes notches (one of which is designated 220) created in the dielectric material on the opposing inside flanges 203 of the terminal bobbin 202 for supporting an isolation barrier.

The magnetic device 200 further includes the inner winding 212 and the outer winding 214. Either the inner winding 212 or the outer winding 214 may be used as the primary winding or the secondary winding of the magnetic device 200, depending on the application which the magnetic device 200 is employed. The magnetic device 200 still further includes an isolation barrier (e.g., insulation tape 216 and insulating plate 218) placed between the inner winding 212 and the outer winding 214.

The terminal bobbin 202 is formed about the plurality of terminals 204. The terminals 204 are molded into the terminal bobbin 202 (e.g., the terminal bobbin 202 is composed of a moldable dielectric material) as a one-piece assembly. Of course, other materials and assembly types for the construction of the terminal bobbin 202 are well within the broad scope of the present invention.

The following features of the terminal bobbin 202 provide several advantages, but are not required to conform with the broad scope of the present invention. The orientation of the terminals 204 facilitates the use of automatic equipment to dispose the inner and outer windings 212, 214 about the winding guide 206 of the terminal bobbin 202. The orientation of the terminals 204 also facilitates coupling (e.g., through a soldering process) of all the leads of the inner and outer windings 212, 214 to the respective terminals 204. The terminals 204 are typically long enough to accommodate more than one winding lead thereby allowing more sophisticated winding patterns to be employed with the magnetic device 200 for enhanced high frequency component performance.

The lead slots 210 on the terminal bobbin 202 also assist in the arrangement of the leads of the inner and outer windings 212, 214 on the terminals 204. The lead slots 210 facilitate a better connection by trapping the leads of the inner and outer windings 212, 214 within the lead slots 210 and isolating particular leads from one another where such isolation is advantageous. In addition, the lead slots 210 permit the leads of the inner winding 212 to pass through, rather than over, the molded-in margins 208 in the winding guide 206. By passing through rather than over the molded-in margins 208, the leads of the inner winding 212 pass farther away from the outer winding 214 than in transformers found in the prior art. The magnetic device 200 also includes a magnetic core (see FIG. 1) having a first core half and a second core half. The terminal bobbin 202 includes a core aperture (not shown), formed through the terminal bobbin 202, to guide and constrain the core halves on the magnetic device 200.

The inner winding 212 is disposed about the winding guide 206 of the terminal bobbin 202 on an axis parallel to the terminals 204. This arrangement allows an automatic winding machine to wind and terminate the inner winding 212 easily. The leads of the inner winding 212 are typically soldered to appropriate terminals 204 located closest the center of the terminal bobbin 202. In addition, the leads of the inner winding 212 are positioned within respective lead slots 210 to distance them from other leads, the outer winding 214, and the magnetic core, as well as to allow the leads to pass through both the molded-in margins 208 and the opposing inside flanges 203. As mentioned above, the terminals 204 may be adapted to receive multiple winding leads. Those skilled in the art understand that allowing various patterns of winding leads is advantageous when the magnetic device 200 is to handle high frequency electrical signals or the magnetic device 200 is employed in other advantageous embodiments.

The notches 220 formed in inside faces of the opposing inside flanges 203 of the terminal bobbin 202 are included to position and support the isolation barrier therein. The isolation barrier is positioned within the notches 220 across the winding guide 206 of the terminal bobbin 202 and atop the inner winding 212. In the illustrated embodiment, the insulation tape 216 is placed around the inner winding 212 to insulate the inner winding 212 from both the outer winding 214 and the core. In addition, the insulation tape 216 is placed around the center of the isolation plate 218 to secure its position within the notches 220 of the terminal bobbin 202. Although the isolation barrier is illustrated as an insulating plate 218, the broad scope of the present invention is not so limited. In fact, the isolation barrier may itself simply be constructed of insulation tape 216 guaranteeing a minimum creepage distance by extending past the molded-in margins 208 and past the opposing inside flanges 203 of the terminal bobbin 202.

Although the insulating tape 216 is placed around the entire inner winding 212 to insulate it from the outer winding 214, the leads of the inner winding 212 remain uninsulated from the outer winding 214 when passing through their respective lead slots 210 and terminating at their respective terminals 204. The point at which the leads of the inner winding 212 pass closest to the outer winding 214 indicate the point where creepage between the inner and outer windings 212, 214 is most likely to occur. As discussed above, in an effort to decrease creepage between the inner and outer windings 212, 214 standards have been established to assure a minimum creepage distance depending on the specifications of the magnetic device 200 and the application into which the magnetic device 200 is employed. By positioning the isolation barrier (e.g., the insulation plate 218) within the notches 220 in the terminal bobbin 202 and between the inner and outer windings 212, 214, a minimum creepage distance between the inner and outer windings 212, 214 is achieved.

The notches 220 in the terminal bobbin 202 extend past the molded-in margins 208 on the opposing inside flanges 203. As a result, the isolation barrier extends the insulation between the inner and outer windings 212, 214 to an acceptable aspect. In addition, because the lead slots 210 pass through the molded-in margins 208 as well as the opposing inside flanges 203, the leads of the inner winding 212 pass through the sides of the terminal bobbin 202 farther away from the outer winding 214 than magnetic devices found in the prior art. Thus, as the leads of the inner winding 212 pass from the winding guide 206, under the outer winding 214, and through their respective lead slots 210, a minimum creepage distance can be assured between the inner and outer windings 212, 214 by a thickness of the isolation barrier (e.g., the insulation plate 218).

Moreover, the isolation barrier can be constructed to various specifications, thus conforming to the various standards regarding creepage distance that may be imposed. In addition, because the notches 220 designed to position the isolation barrier can be created during the same manufacturing process used to initially create the terminal bobbin 202 (e.g., plastic injection molding), a magnetic device 200 constructed according to the principles of the present invention can be manufactured in less time and with less cost than a magnetic device found in the prior art using wire lead sleeves to insulate the leads of the inner winding 212 from the outer winding 214.

Figure 3:
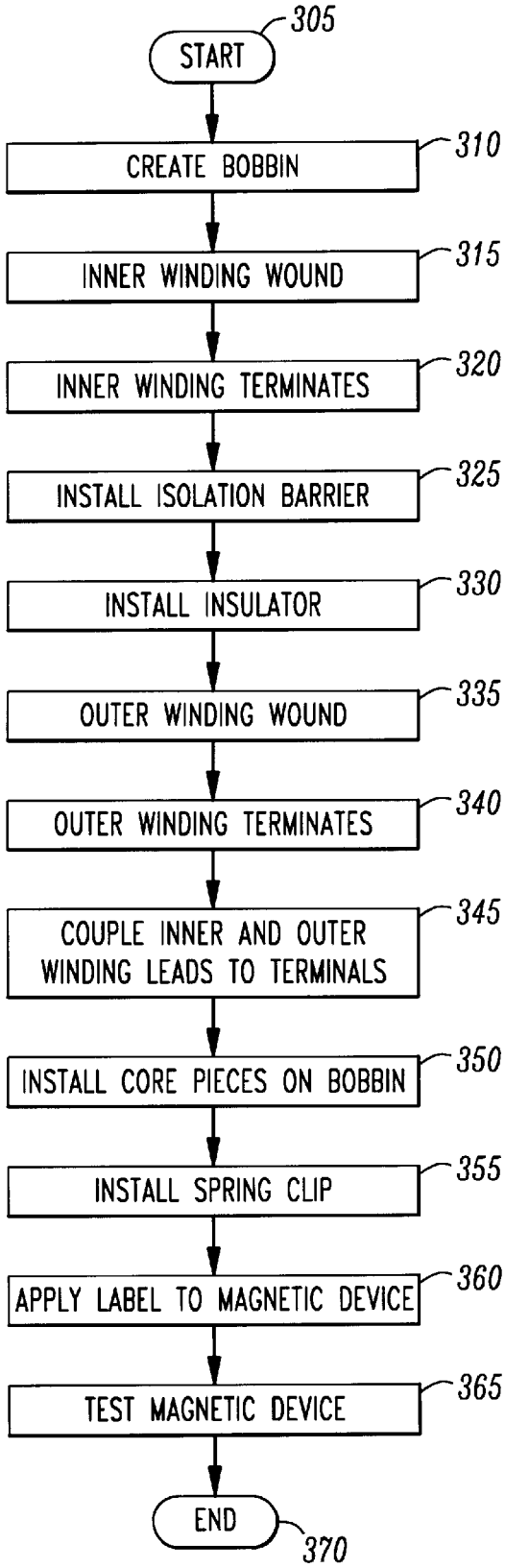
FIG. 3 illustrates a flow diagram of the method of manufacturing a magnetic device according to the principles of the present invention.

Turning now to FIG. 3, illustrated is a flow diagram of the method of manufacturing a magnetic device according to the principles of the present invention. The method begins at a start step 305. Then, a terminal bobbin is first created at a create bobbin step 310. The terminal bobbin is formed about a plurality of terminals (e.g., injection molding a plastic material about the terminals) during the create bobbin step 310. In addition, the terminal bobbin includes a winding guide for receiving inner and outer windings. An aperture is also developed through the terminal bobbin to accommodate a center leg of a magnetic core. Also, opposing inside flanges are formed on a surface of the terminal bobbin. The opposing inside flanges are notched in at least one place and are adapted to receive an isolation barrier.

The inner winding is wound about the terminal bobbin at an inner winding wound step 315. The inner winding is disposed on the terminal bobbin (e.g., machine-winding of the wire about an axis parallel to the terminals) between molded-in margins proximate the winding guide during the inner winding wound step 315. The leads of the inner winding then terminate at the terminals molded into the terminal bobbin at an inner winding terminates step 320.

An isolation barrier (e.g., an insulating plate) is then installed atop the inner winding at an install isolation barrier step 325. The isolation barrier is adapted to rest in the notches created in the opposing inside flanges during the create bobbin step 310 discussed above. While positioned in the notches created in the opposing inside flanges, the isolation barrier is adapted to extend past the winding guide and molded-in margins of the terminal bobbin on both ends. Once the isolation barrier is in place, an insulator (e.g., insulation tape) is installed around the inner winding during an install insulator step 330 to further isolate the inner winding from an outer winding. The insulator is also installed around the isolation barrier to prevent its movement or displacement from the notches made in the opposing inside flanges.

The outer winding is wound about the inner winding at an outer winding wound step 335. Because the insulator and isolation barrier were both installed atop the inner winding in prior steps of the manufacturing process, the outer winding is wound around the insulator and isolation barrier during the outer winding wound step 335. Like the inner winding, the outer winding is disposed on the terminal bobbin (e.g., machine-winding of the wire about an axis parallel to the terminals) under the constraint of the winding guide between the opposing inside flanges. The leads of the outer winding then terminate at other terminals molded into the terminal bobbin at an outer winding terminates step 340.

The leads of both the inner and outer windings are then coupled (e.g., through a soldering process) to their respective terminals at a couple inner and outer winding leads to terminals step 345. The magnetic core is then placed on the terminal bobbin under constraint of the core aperture at an install core pieces on bobbin step 350. Of course, for some applications (e.g., "air-core" magnetic devices) it is unnecessary to include a magnetic core on the bobbin, and such magnetic devices are within the broad scope of the present invention. A spring clip is then placed over the two halves of the E-core of the magnetic device in an install spring clip step 355.

Next, a label, if necessary, is applied to the magnetic device in an apply label to magnetic device step 360. The label is applied to the magnetic device to identify the specifications of the device, the model number, or to disclose other similar information regarding the magnetic device or its operation. Of course, applying a label to the magnetic device is not necessary to the broad scope of the present invention. Once manufactured through the above-mentioned steps, the magnetic device may be tested as required for proper operation at a test magnetic device step 365. The method concludes at an end step 370.

For a better understanding of magnetic devices (including bobbin structures) and construction techniques therefor see Soft Ferrites, by E.C. Snelling, Butterworth (1988). For a general reference regarding electronics including communication systems employing magnetic devices see *Reference Data for Engineers: Radio, Electronics, Computers and Communications*, 7th edition, Howard W. Sams & Company (1988). The aforementioned references are herein incorporated by reference.

Although the present invention has been described in detail, those skilled in the art should understand that they can make various changes, substitutions and alterations herein without departing from the spirit and scope of the invention in its broadest form.

What is claimed is:

1. A magnetic device, comprising:

a bobbin having a winding guide and molded-in margins proximate opposing inside flanges of said bobbin, each of said opposing inside flanges having at least one notch formed in an inside face of each of said opposing inside flanges;

an inner winding wound about said winding guide and between said molded-in margins;

an outer winding wound about said inner winding and said winding guide and between said flanges; and an insulating plate, provided in said at least one notch and interposed between said inner and outer windings, a thickness of said insulating plate providing a predetermined creepage distance between at least one lead of said inner winding and said outer winding.

2. The magnetic device as recited in claim 1 further comprising a magnetic core proximate said inner and outer windings.

3. The magnetic device as recited in claim 2 further comprising a spring clip coupled to said bobbin for retaining said magnetic core on said bobbin.

4. The magnetic device as recited in claim 1 wherein said insulating plate is selected from the group consisting of:

a molded plastic plate;

a polyamide plate; and a nomex plate.

5. The magnetic device as recited in claim 1 further comprising a layer of insulating tape.

6. The magnetic device as recited in claim 1 wherein said predetermined creepage distance is determined by a safety standard.

7. The magnetic device as recited in claim 1 wherein said molded-in margins further include slots configured to allow said at least one lead of said inner winding to pass through said molded-in margins to terminate on a winding terminal of said magnetic device.

8. The magnetic device as recited in claim 1 wherein said flanges further include slots configured to allow at least one lead of said outer winding to pass through said flanges to terminate on a winding terminal of said magnetic device.

* * * * *